US005988120A

United States Patent [19]

Betsch et al.

[11] Patent Number: 5,988,120

[45] Date of Patent: Nov. 23, 1999

[54] LIQUID-COOLED CYLINDER BLOCK AND CRANKCASE

[75] Inventors: Jochen Betsch, Waiblingen; Arnold Kaden, Remshalden; Georg Stumpp, Luwigsburg, all of Germany

[73] Assignee: Daimler-Genz Aktiengesellschaft, Stuttgart, Germany

[21] Appl. No.: 09/079,235

[22] Filed: May 15, 1998

[30] Foreign Application Priority Data

May 15, 1997 [DE] Germany ..... 197 20 380

[51] Int. Cl.[6] ..... F01P 3/02

[52] U.S. Cl. ..... 123/41.74

[58] Field of Search ..... 123/41.79, 41.74, 123/41.84

[56] References Cited

U.S. PATENT DOCUMENTS

| | | | |
|---|---|---|---|
| 2,413,753 | 1/1947 | Dittmar | 123/41.79 |
| 4,493,294 | 1/1985 | Umemura | 123/41.74 |
| 4,672,923 | 6/1987 | Wahnschaffe et al. | 123/41.74 |
| 4,779,578 | 10/1988 | Eiermann | 123/41.79 |
| 4,794,884 | 1/1989 | Hilker et al. | 123/41.79 |
| 4,926,801 | 5/1990 | Eisenberg et al. | 123/41.84 |
| 4,930,470 | 6/1990 | Kabat et al. | 123/41.74 |
| 5,505,167 | 4/1996 | Kennedy | 123/41.79 |

FOREIGN PATENT DOCUMENTS

| | | |
|---|---|---|
| 0 261 506 | 3/1988 | European Pat. Off. . |
| 36 23 742 | 1/1988 | Germany . |
| 36 32 159 | 3/1988 | Germany . |
| 195 11 864 | 7/1996 | Germany . |
| 57-153942 | 9/1982 | Japan . |

*Primary Examiner*—Noah P. Kamen
*Assistant Examiner*—Jason Benton
*Attorney, Agent, or Firm*—Evenson, McKeown, Edwards & Lenahan, P.L.L.C.

[57] ABSTRACT

In a liquid-cooled cylinder block and crankcase in an open-deck construction, a displacement body is placed in the coolant space. The shape of the displacement body approaches the shape of the coolant space. The interior wall of the displacement body, together with the exterior surface of the cylinder block containing the cylinders, bound a narrow gap which is connected with the coolant inlet connection. As the result, the coolant is forced to flow along the cylinder block so that an intensive cooling is achieved with a reduced coolant quantity.

15 Claims, 3 Drawing Sheets

LIQUID-COOLED CYLINDER BLOCK AND CRANKCASE

BACKGROUND AND SUMMARY OF THE INVENTION

This application claims the priority of German application 197 20 380.9-13, filed in Germany on May 15, 1997, the disclosure of which is expressly incorporated by reference herein.

The invention relates to a liquid-cooled cylinder block and crankcase.

Such crankcases, which are known, for example, from German Patent Document DE 195 11 864 C, can be manufactured by diecasting. In this case, the volume of the coolant space is determined by the requirements of the casting mold. This volume can therefore not be optimally designed for the cooling of the cylinders.

It is an object of the invention to provide a cylinder block and crankcase of the above-mentioned type in the case of which the cooling of the cylinders is optimized.

This and other objects have been achieved according to the present invention by providing a liquid-cooled cylinder block and crankcase in an open-deck construction, having exterior walls which form an upper flange surface for the cylinder head and enclose a coolant space which is open toward the flange surface, a coolant inlet connection leading into the coolant space, cylinders of said cylinder block being arranged at a distance from the exterior walls, wherein a displacement body is placed in the coolant space and surrounds the cylinders or the cylinder block containing the cylinders, a gap being defined between an interior wall of the displacement body and an exterior surface of the cylinders or of the cylinder block, said gap being communicated with the coolant inlet connection.

This and other objects have also been achieved according to the present invention by providing an arrangement comprising a cylinder block including an exterior wall and at least one cylinder, said at least one cylinder being spaced from said exterior wall to define a coolant space therebetween; a displacement body being arranged in said cylinder block in said coolant space between said exterior wall and said at least one cylinder.

This and other objects have also been achieved according to the present invention by providing a displacement body for a cylinder block having an exterior wall and at least one cylinder spaced from the exterior wall to define a coolant space therebetween, said displacement body being configured to be arranged in said cylinder block in said coolant space between said exterior wall and said at least one cylinder.

This and other objects have also been achieved according to the present invention by providing a method of reducing a coolant space between an exterior wall of a cylinder block and at least one cylinder, said method comprising arranging a displacement body in said cylinder block in said coolant space between said exterior wall and said at least one cylinder.

By placing the displacement body in the coolant space, a forced flow is obtained along the walls of the cylinders as well as a considerably improved cooling of the particularly critical web areas between adjacent cylinders. Thus, a uniform cooling is achieved which reduces the knocking tendency. Furthermore, the displacement body causes a clear reduction of the coolant quantity which results in a fast warm-up of the internal-combustion engine with positive effects on the pollutant emissions, the friction output, the driving comfort and the response behavior of the heater, and the water pump output can be reduced which has a positive effect on the fuel consumption.

The coolant quantity can be reduced further if the shape of the displacement body approaches the shape of the coolant space so that coolant flows essentially only through the gap between the displacement body and the cylinders or the cylinder block containing the cylinders.

In order to achieve a flow around the cylinders or the cylinder block which is as uniform as possible, a spoiler can be arranged on the displacement body which extends in the direction of the coolant inlet connection and divides the coolant flow into two partial flows which are guided through passage openings on both sides of the spoiler along the cylinders or the cylinder block on one side and on the other side of the cylinder block and crankcase.

As mentioned above, the web areas between the cylinders are particularly endangered. In order to ensure a good cooling of these areas, the interior wall of the displacement body should extend as close as possible to these areas so that the coolant flow will be forced to sweep over these areas and dead water zones are avoided.

The displacement body should preferably have a low heat capacity which can be achieved by a corresponding material, such as a plastic material, and/or in that the displacement body is constructed as a hollow body.

Other objects, advantages and novel features of the present invention will become apparent from the following detailed description of the invention when considered in conjunction with the accompanying drawings.

DETAILED DESCRIPTION OF THE DRAWINGS

Figure 1:
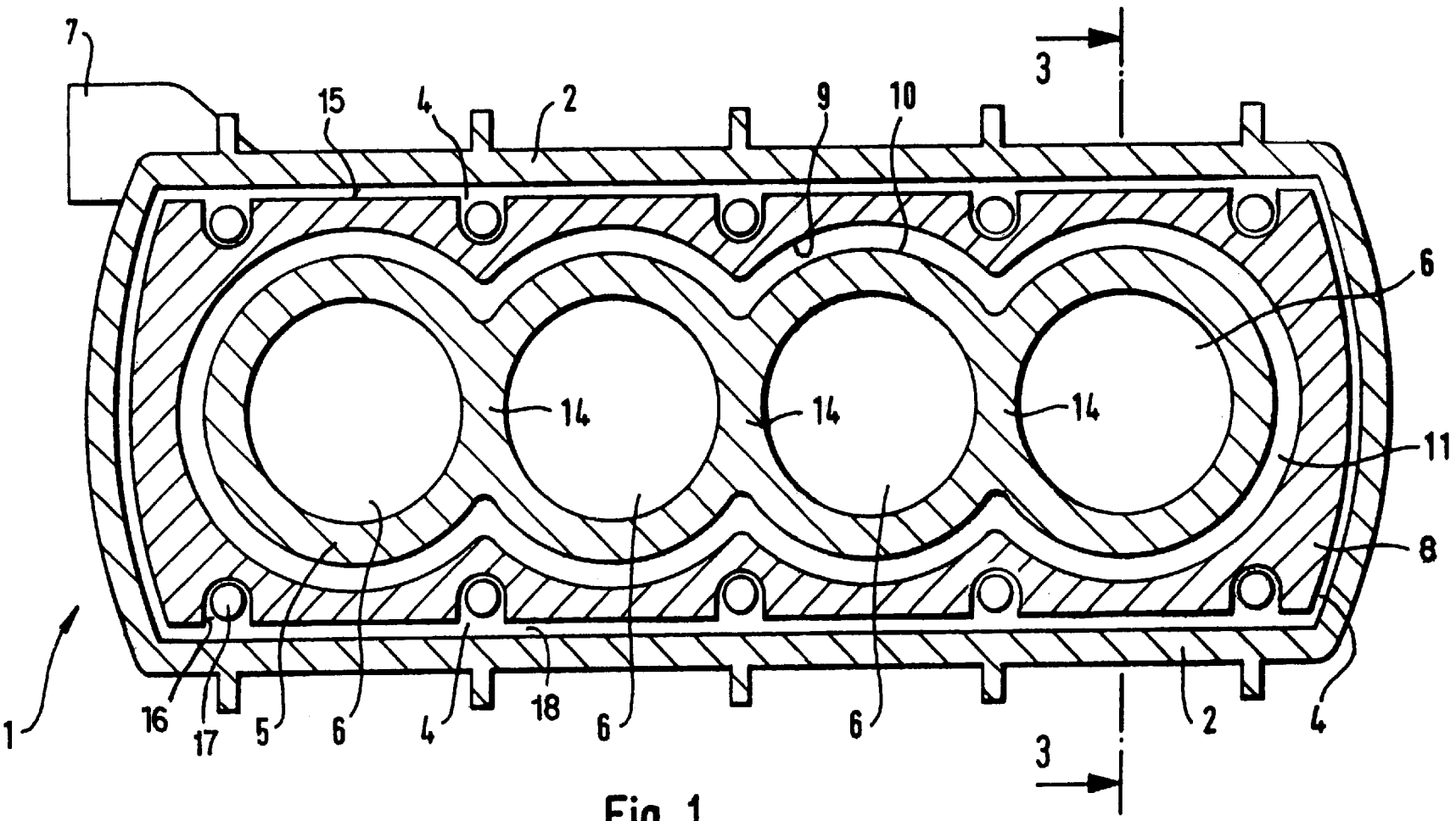
FIG. 1 is a horizontal, longitudinal sectional view of a cylinder block and crankcase according to a preferred embodiment of the present invention.

The cylinder block and crankcase 1 has exterior walls which form an upper flange surface 3 for a cylinder head, which is not shown, and enclose a coolant space 4 which is open toward the flange surface 3 so that the crankcase can be manufactured by diecasting. The cylinders 6, which are combined to a cylinder block 5, are arranged in the coolant space 4. The cylinder block 5 is formed in one piece with the crankcase 1 and is situated at a distance from the exterior walls 2. A coolant inlet connection 7 leads into the coolant space 4.

Figure 4:
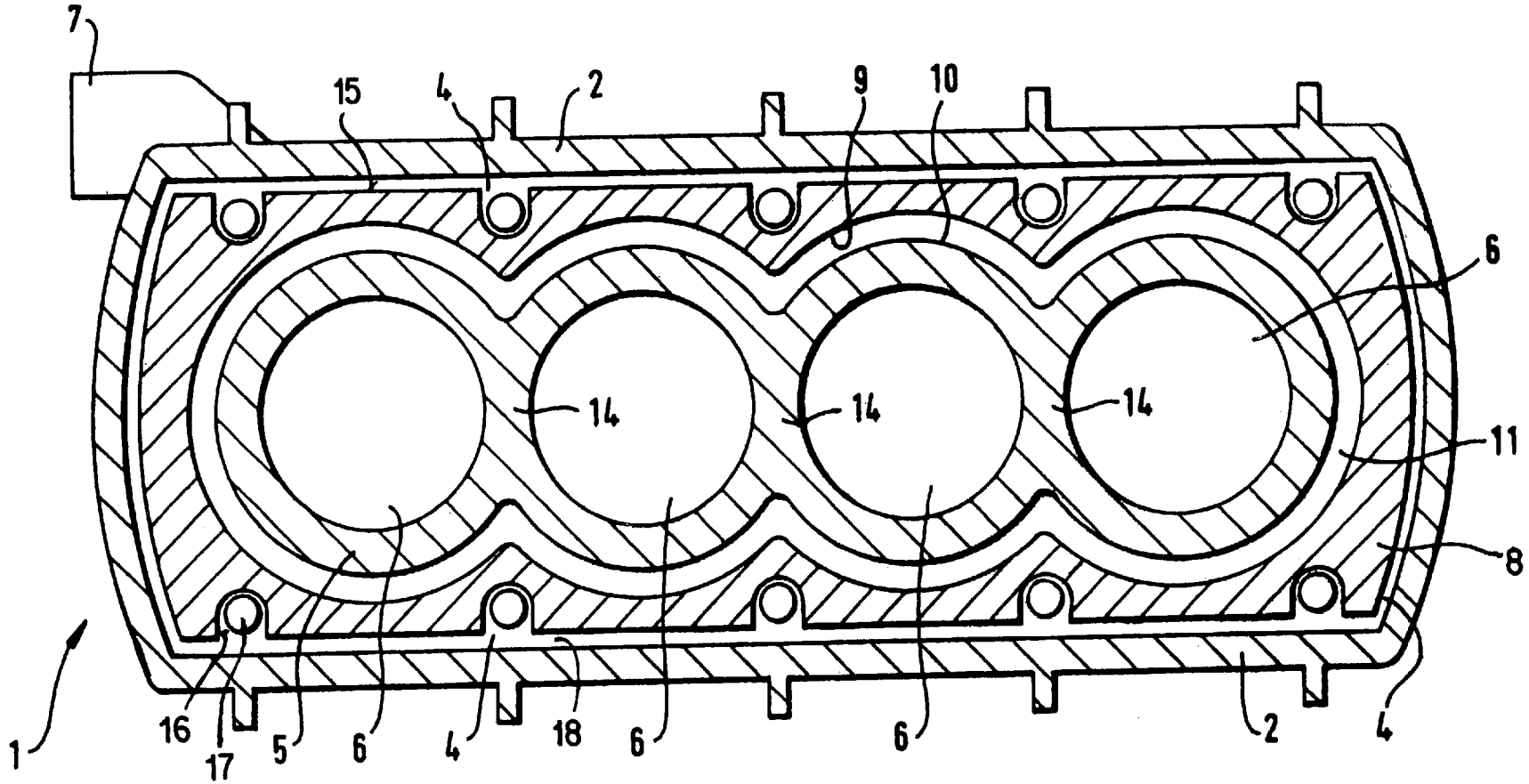
FIG. 4 is a sectional view of a hollow displacement body.

A displacement body 8, whose shape approaches (corresponds to) the shape of the coolant space, is placed in the coolant space 4. The displacement body 8 preferably is made of a material having a low heat capacity, for example plastic, and/or the displacement body may be hollow, as shown in FIG. 4. Alternatively, the displacement body may be made of aluminum, an aluminum alloy, or various other materials known in the art. The hollow displacement body of FIG. 4 is shown as a cut-away section; so it should be clearly understood that the hollow body is sealed at upper and lower ends (i.e. defines a closed interior space) to prevent coolant from entering the hollow body.

The displacement body 8 may simply be held in place between the cylinder head and the cylinder block, for example by corresponding engaging surfaces, or may alternatively or additionally be held in place by fasteners. As shown in FIG. 1, recesses 16 are formed along the exterior wall 15 of the displacement body 8, the recesses providing access to cylinder head screws 17 which may also support the displacement body. A gap 18 is defined between the exterior wall 15 of the displacement body 8 and the inside of the exterior walls 2. The gap 18 allows a portion of the coolant to cool this area, as well as providing tolerances, for example for assembly and due to expansion/contraction of the cylinder block and the displacement body. One skilled in the art would recognize that the size of the gap 18 could be varied depending on various factors, for example the cooling requirements of the engine, the materials of the cylinder block and of the displacement body, the coolant capacity, the coolant pump size and flow specifications, etc. It is contemplated that in certain designs, the gap 18 could be very small or even eliminated altogether.

The interior wall 9 of the displacement body 8, together with the exterior surface 10 of the cylinder block 5, bounds a relatively narrow gap 11 which is connected with the inlet connection 7 by way of openings 12 (FIG. 2) in the wall of the displacement body 8.

Figure 2:
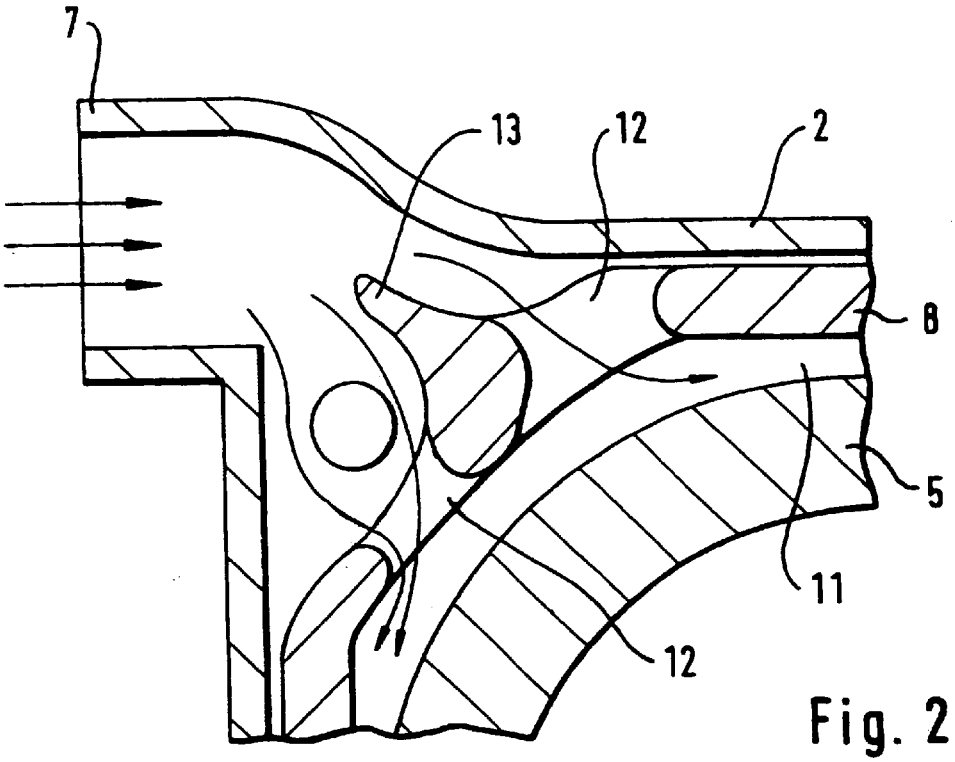
FIG. 2 is an enlarged partial longitudinal sectional view in the area of the coolant inlet connection.
Figure 3:
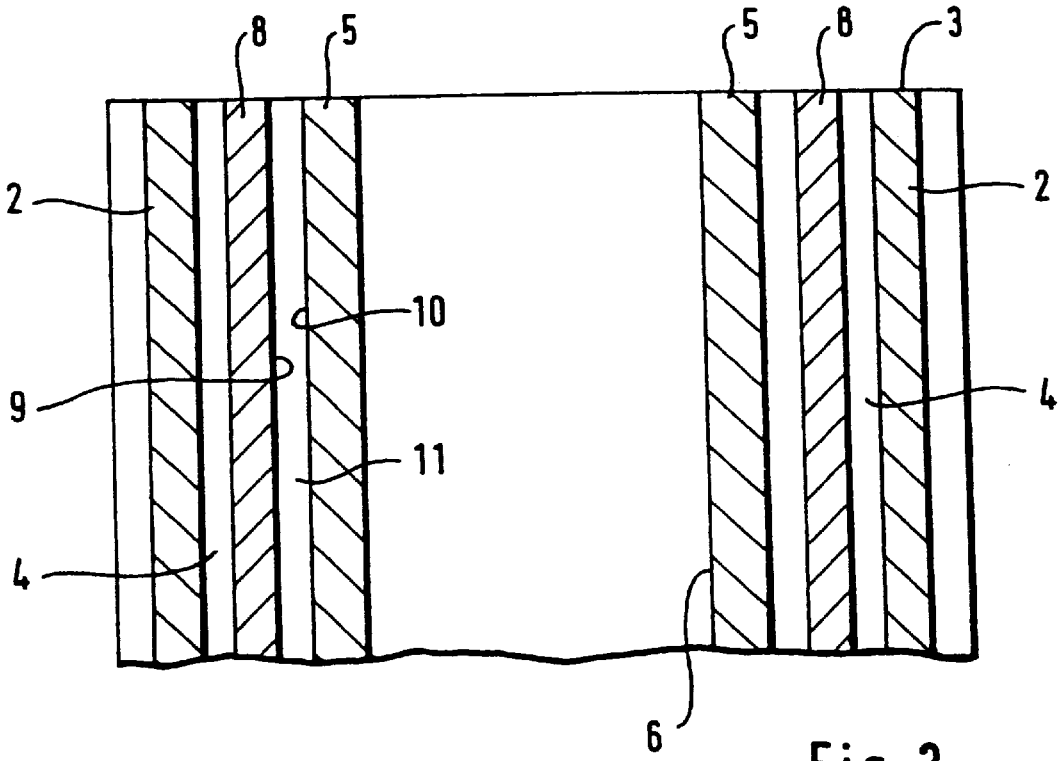
FIG. 3 is a sectional view along Line 3—3 in FIG. 1.

In order to achieve a distribution of the coolant flow to both sides of the cylinder block 5 formed by the cylinders 6, as illustrated in FIG. 2, a spoiler 13 (i.e., a flow-directing structure is molded to the displacement body 8, extends in the direction of the inlet connection 7 and divides the coolant flow into two partial flows which enter the gap 11 through the openings 12 provided on each side of the spoiler and of which one partial flow flows along the cylinder block 5 on one side and the other partial flow flows along the cylinder block 5 on the other side of the cylinder block and crankcase 1 through the gap 11.

As illustrated in FIG. 1, the interior wall 9 of the displacement body 8 extends at a relatively narrow distance from the exterior surface 10 of the cylinder block 5 and mainly from the web areas 14 between adjacent cylinders 6 so that the coolant is forced to flow along the exterior wall 10 of the cylinder block and causes an intensive cooling particularly also of the critical web areas.

One skilled in the art would recognize that the size of the gap 11 could be varied depending on various factors, for example the cooling requirements of the engine, the materials of the cylinder block and of the displacement body, the coolant capacity, the coolant pump size and flow specifications, etc.

Naturally, the invention can also be used in the case of a cylinder block and crankcase with individually standing cylinders or wet cylinder liners.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A liquid-cooled cylinder block and crankcase in an open-deck construction, comprising:

a crankcase including exterior walls which form an upper flange surface for receiving a cylinder heads, a cylinder block arranged at a distance from said exterior walls, said cylinder block defining cylinders, said crankcase and said cylinder block defining a coolant space which is open toward the flange surface, a coolant inlet connection leading into the coolant space, wherein a displacement body is placed in the coolant space and surrounds the cylinder block, a gap being defined between an interior wall of the displacement body and an exterior surface of the cylinder block, said gap being communicated with the coolant inlet connection.

2. A cylinder block and crankcase according to claim 1, wherein the displacement body has a shape which approaches the shape of the coolant space.

3. A cylinder block and crankcase according to claim 1, wherein a spoiler is molded to the displacement body, said spoiler extending toward the coolant inlet connection and dividing a coolant flow into two partial flows, said displacement body defining at least one passage opening on each side of the spoiler for the two partial flows.

4. A cylinder block and crankcase according to claim 1, wherein said cylinder block includes web areas between said cylinders, and wherein the interior wall of the displacement body extends to close to said web areas.

5. A cylinder block and crankcase according to claim 1, wherein the displacement body has a low heat capacity.

6. A cylinder block and crankcase according to claim 5, wherein the displacement body is constructed as a hollow body.

7. A cylinder block and crankcase according to claim 5, wherein the displacement body consists of a plastic material.

8. A cylinder block and crankcase according to claim 1, wherein said crankcase and said cylinder block are cast in one piece.

9. An arrangement comprising:

a crankcase including exterior walls for receiving a cylinder head;

a cylinder block cast in one piece with said crankcase, said cylinder block including at least one cylinder spaced from said exterior walls to define a coolant space therebetween;

a displacement body being arranged in said coolant space between said exterior walls of said crankcase and said cylinder block.

10. An arrangement according to claim 9, wherein said displacement body is configured to surround said cylinder block, an interior surface of said displacement body being spaced from an exterior surface of said cylinder block to define a gap therebetween.

11. An arrangement according to claim 9, wherein said displacement body defines at least one coolant inlet opening.

12. An arrangement according to claim 11, wherein said displacement body defines two coolant inlet openings, said displacement body formed as a flow-directing spoiler between said two coolant inlet openings.

13. An arrangement according to claim 12, wherein said cylinder block defines a coolant inlet proximate said spoiler.

14. A method of reducing a coolant space between an exterior wall of a crankcase and a cylinder block cast in one piece with said crankcase, said method comprising arranging a displacement body in said coolant space between said exterior wall and said cylinder block.

15. A method according to claim 14, wherein said displacement body is configured to surround said cylinder block such that an interior surface of said displacement body is spaced from an exterior surface of said cylinder block to define a gap therebetween.

* * * * *